US010294072B2

(12) United States Patent
Zhao et al.

(10) Patent No.: US 10,294,072 B2
(45) Date of Patent: May 21, 2019

(54) ELEVATOR CAPABLE OF MONITORING USE OF CHILD AND A CONTROL METHOD THEREOF

(71) Applicant: Otis Elevator Company, Farmington, CT (US)

(72) Inventors: Jianwei Zhao, Shanghai (CN); Hui Fang, Shanghai (CN); Qiang Li, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 30 days.

(21) Appl. No.: 15/182,240

(22) Filed: Jun. 14, 2016

(65) Prior Publication Data

US 2016/0368734 A1 Dec. 22, 2016

(30) Foreign Application Priority Data

Jun. 16, 2015 (CN) ..... 2015 1 0331620

(51) Int. Cl.
*B66B 5/00* (2006.01)
*B66B 29/00* (2006.01)
*B66B 25/00* (2006.01)

(52) U.S. Cl.
CPC ..... *B66B 5/0012* (2013.01); *B66B 25/00* (2013.01); *B66B 29/005* (2013.01); *B66B 2201/104* (2013.01)

(58) Field of Classification Search
USPC ..... 187/247
See application file for complete search history.

(56) References Cited

U.S. PATENT DOCUMENTS 4,951,786 A * 8/1990 Haraguchi ..... B66B 1/3484 187/391
5,255,301 A 10/1993 Nakamura et al.
5,844,487 A 12/1998 Britt
6,341,668 B1 1/2002 Fayette et al.
7,044,271 B2 5/2006 De Coi
8,420,998 B2 4/2013 Iwasawa
8,523,667 B2 9/2013 Clavin et al.
(Continued)

FOREIGN PATENT DOCUMENTS

CN 102910510 A 2/2013
EP 2316777 A1 8/2008
(Continued)

OTHER PUBLICATIONS

Avery, William, "Kinect", wikipedia, Feb. 26, 2015, retrieved from internet, pp. 1-14.
(Continued)

*Primary Examiner* — Christopher Uhlir
(74) *Attorney, Agent, or Firm* — Cantor Colburn LLP

(57) ABSTRACT

The present invention relates to the technical field of elevator control, and provides an elevator system capable of monitoring children use and a control method thereof. The elevator system of the present invention includes: an elevator control system; an RGB-D sensor or an intelligent wearable device; and an information analytic processing apparatus. The elevator system and control method thereof in the present invention is accurate, reliable and safe when monitoring the situation of children using the elevator.

17 Claims, 4 Drawing Sheets

(56) References Cited

U.S. PATENT DOCUMENTS

| | | | | |
|---|---|---|---|---|
| 2012/0000733 | A1 | 1/2012 | Finshi | |
| 2012/0075110 | A1 | 3/2012 | Boughorbel et al. | |
| 2013/0182905 | A1* | 7/2013 | Myers | H04N 7/18 382/103 |
| 2014/0267758 | A1 | 9/2014 | Neff et al. | |
| 2014/0331242 | A1* | 11/2014 | De La Garza | H04N 21/44218 725/12 |
| 2015/0053509 | A1 | 2/2015 | Friedli | |
| 2016/0368741 | A1* | 12/2016 | Blondiau | B66B 25/00 |

FOREIGN PATENT DOCUMENTS

| | | | |
|---|---|---|---|
| EP | 2784016 | A1 | 10/2014 |
| JP | H05278977 | A | 10/1993 |
| JP | H0616372 | A | 1/1994 |
| JP | H11335046 | A | 12/1999 |
| JP | 2007001758 | A | 1/2007 |
| JP | 2012121710 | A | 6/2012 |
| WO | 2014167172 | A1 | 10/2014 |

OTHER PUBLICATIONS

Macfarland, Matt "One day an elevator might ask—Are you getting on?", The Washington Post—Innovations, Jan. 22, 2014, 2 pages.
Partial European Search Report for application EP 16174748.0, dated Nov. 21, 2016, 9 pages.
European Search Report for application EP 16174748.0, dated Mar. 8, 2017, 31pgs.

* cited by examiner

ELEVATOR CAPABLE OF MONITORING USE OF CHILD AND A CONTROL METHOD THEREOF

PRIORITY

This application claims priority to Chinese Patent Application No. 201510331620.8, filed Jun. 16, 2015, and all the benefits accruing therefrom under 35 U.S.C. § 119, the contents of which in its entirety are herein incorporated by reference.

TECHNICAL FIELD

The present invention relates to the technical field of elevator control, and in particular, to an elevator system capable of monitoring children use and a control method thereof.

BACKGROUND

As a convenient passenger transport tool, elevators are widely applied in buildings, for example, in fields such as office buildings, shopping malls and schools. More and more passengers tend to take an elevator system because of its good ride experiences, especially for children or kids, the elevator system seems to bring fresh experiences for them, and they are willing to ride various types of elevators, including a vertical elevator (also referred to as a lift) and an escalator.

Because of the universal application of the elevator, it is very easily overlooked by the general passengers that the elevator is a special device and has a certain safety risk, especially when a child takes the elevator alone, a large safety risk exists; and therefore, monitoring on children taking the elevator is easily neglected. As a result, elevator providers or units using elevators generally require that children should be accompanied by guardians thereof while taking elevators, so as to avoid safety accidents.

In the existing elevator systems, there are various technologies proposed for monitoring or identifying whether a child takes an elevator alone, for example, the Chinese Patent Application No. CN201110227551.8 entitled "Control Device for Preventing Children from Taking Elevator Alone" discloses that human body heat-sensing detectors are used to determine whether a child is accompanied by a corresponding guardian, thereby preventing the child from taking an elevator alone. However, in the elevator system in the prior art, mistaken identification on children exists, which on one hand does not implement the overall monitoring on children taking an elevator alone, thereby having certain safety risks, and on the other hand easily affects normal running of the elevator.

SUMMARY

An objective of the present invention is to implement accurate monitoring on a situation of children using an elevator.

Another objective of the present invention is to reduce the occurrence probability of safety accident when children take an elevator.

To implement the above or other objectives, the present invention provides the following technical solutions.

According to an aspect of the present invention, an elevator system capable of monitoring children use is provided, which includes an elevator controlling apparatus, and further includes:

an RGB-D sensor, mounted at a predetermined position to at least acquire red green blue (RGB) information and depth (D) information; and an information analytic processing apparatus, configured to perform real-time analytic processing on at least the D information or a combination of the RGB information and the D information, so as to implement detection and determination on a child.

According to another aspect of the present invention, an elevator system control method capable of monitoring children use is provided, including:

S1: at least acquiring RGB information and depth information through an RGB-D sensor;

S2: performing real-time analytic processing on at least the D information or a combination of the RGB information and the D information, so as to implement detection and determination on a child, and sending an alarm message when all passengers are determined as children;

S3: real-time displaying at least a part of the information acquired by the RGB-D sensor at least when the alarm message is received, and confirming whether the passengers are all children based on the displayed information acquired by the RGB-D sensor; and S4: sending a control instruction used to ensure children safety when it is confirmed that the passengers are all children.

According to still another aspect of the present invention, an elevator system capable of monitoring children use is provided, which includes an elevator controlling apparatus, and further includes:

an intelligent wearable device, worn by a passenger and at least storing age feature information of the passenger; and an information analytic processing apparatus (220), configured to acquire the age feature information of the passenger from the intelligent wearable device and perform real-time analytic processing, so as to implement detection and determination on a child.

According to still another aspect of the present invention, an elevator system control method capable of monitoring children use is provided, including:

S1: at least acquiring age feature information of a passenger from an intelligent wearable device worn by the passenger, and acquiring image information from an image acquiring apparatus;

S2: performing real-time analytic processing on the age feature information, so as to implement detection and determination on a child, and sending an alarm message when all passengers are determined as children;

S3: real-time displaying the image information at least when the alarm message is received, and confirming whether the passengers are all children based on the displayed image information; and S4: sending a control instruction used to ensure children safety when it is confirmed that the passengers are all children.

BRIEF DESCRIPTION OF THE DRAWINGS

The above and other advantages of the present invention will be more complete and clear through the following detailed descriptions with reference to the accompanying drawings, where identical or similar elements are presented by using the same reference numerals.

DETAILED DESCRIPTION

Some of multiple possible embodiments of the present invention are described in the following, are intended to provide basic understanding on the present invention, and are not intended to determine key or critical elements of the present invention or limit the protection scope of the present invention. It is easily understood that, according to the technical solution of the present invention, persons of ordinary skill in the art can propose various other implementation manners that can be replaced with each other, without departing from the essential spirit of the present invention. Therefore, the following specific implementation manners and the accompanying drawings are merely exemplary descriptions on the technical solution of the present invention, and should not be considered as all of the present invention, or as constraints or limitations on the technical solutions of the present invention.

In the following descriptions, for clarity and simplicity, all components of an elevator system are not shown one by one in the accompanying drawings, and multiple components that can completely implement the present invention are shown in the accompanying drawings in a focused manner, and for persons skilled in the art, operations of various components are familiar and apparent.

In this text, a "passenger waiting area" and a "passenger arriving area" are defined with respect to a process of a passenger taking an elevator, and for a certain floor, it may be a "passenger waiting area" of one elevator taking process and may also be a "passenger arrival area" of another elevator taking process.

In this text, "children", also referred to as "kids", refer to younger passengers who take the elevator without being accompanied by guardians and may have safety risks. The specific age range and/or height range corresponding to the definition of the "children" or "kids" may be set according to safety risk evaluation of the elevator.

Figure 1:
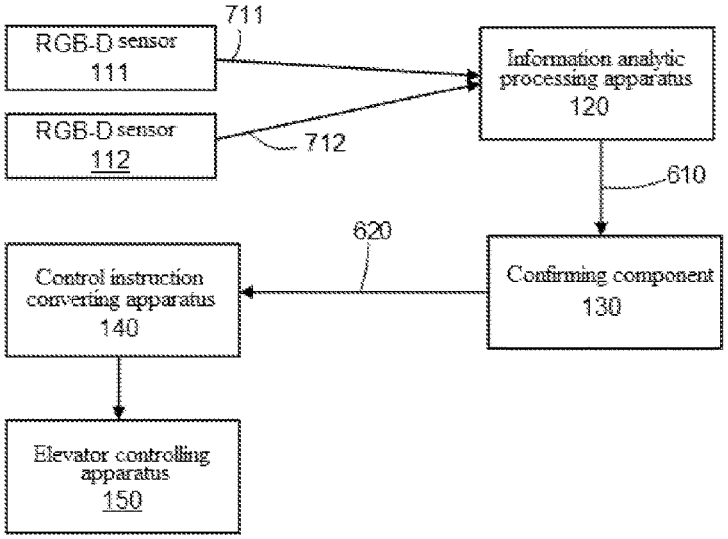
FIG. 1 is a schematic modular structural diagram of an elevator system according to an embodiment of the present invention.

FIG. 1 shows a schematic modular structural diagram of an elevator system according to an embodiment of the present invention. In this embodiment, the elevator system mainly includes an RGB-D (red green blue-depth) sensor, which includes an RGB-D sensor 111 and an RGB-D sensor 112 disposed at different positions. When the elevator system is a vertical elevator (vertical lift) system, at least one RGB-D sensor 111 is disposed at a passenger waiting area 81, and at least one RGB-D sensor 112 is disposed in an elevator cabin 190 of the elevator system. The RGB-D sensors 111 and 112 are one type of 3D sensors, which can acquire red green blue (RGB) information and depth (D) information, the RGB information is planar image information, and therefore, a colorful planar image and a depth image may be obtained respectively based on the RGB information and the D information. The specific type of the RGB-D sensors 111 and 112 are not limited, and corresponding types of RGB-D sensors may be selected to identify children more clearly.

Illustrations are made in the following by using the elevator system being the vertical elevator system as an example.

Figure 2:
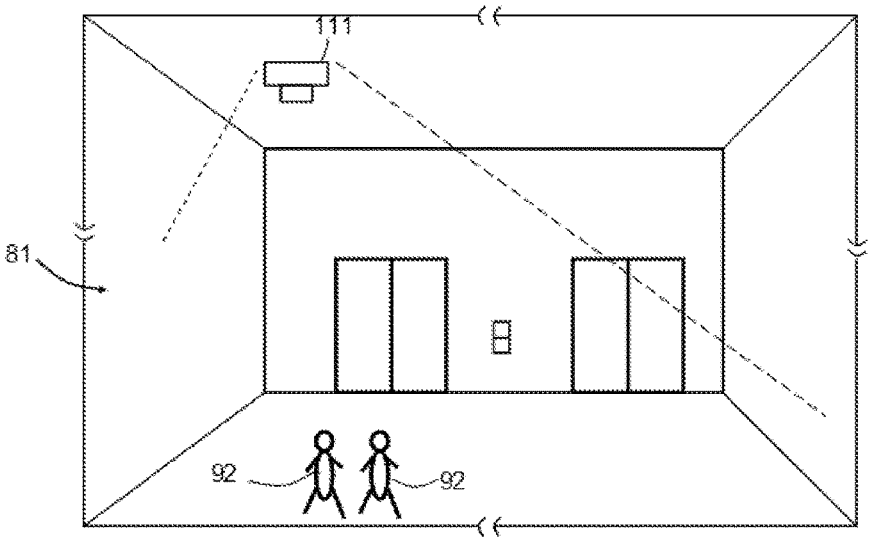
FIG. 2 is an exemplary schematic mounting diagram of mounting an RGB-D sensor at a passenger waiting area.
Figure 3:
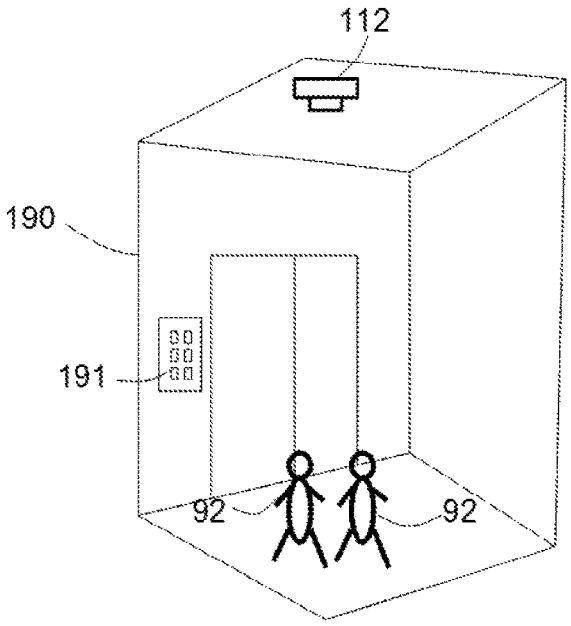
FIG. 3 is an exemplary schematic mounting diagram of mounting an RGB-D sensor in an elevator cabin.

FIG. 2 shows an exemplary schematic mounting diagram of mounting an RGB-D sensor at a passenger waiting area; and FIG. 3 shows an exemplary schematic mounting diagram of mounting an RGB-D sensor in an elevator cabin.

Referring to FIG. 1 to FIG. 2, the passenger waiting area 81 may have one or more passengers in a certain period of time. Passengers 92 are schematically shown as children passenger, who are objects monitored by the elevator system of the present invention, especially, using of the elevator system by them is monitored. Definitely, those who are monitored may also include passengers (not shown) other than children, and they are passengers allowed to take the elevator alone, for example, a guardian of the child passenger 92.

The RGB-D sensor 111 is mounted at the passenger waiting area 81, which can collect information related to passengers in a monitoring range thereof, so as to obtain information 711. The information 711 includes RGB information and D information, which may include RGB information and D information related to a foreground of the passenger waiting area 81, and may also include RGB information and D information related to the passenger of the passenger waiting area 81.

Referring to FIG. 1 and FIG. 3, the elevator cabin 190 of the elevator system may have one or more passengers 92 in a certain period of time, and the RGB-D sensor 112 is mounted in the elevator cabin 190, which can collect information related to passengers in the elevator cabin 190, so as to obtain information 712. The information 712 includes RGB information and D information, which may include RGB information and D information related to a foreground of the elevator cabin 190, and may also include RGB information and D information related to the passenger of the elevator cabin 190.

It should be noted that, the RGB-D sensor 111 of the passenger waiting area 81 and the RGB-D sensor 112 of the elevator cabin 190 may adopt RGB-D sensors of the same type, and may also adopt RGB-D sensors of different types. The specific mounting position of the RGB-D sensor in the passenger waiting area 81 or the elevator cabin 190 is not limited by the embodiment shown in the present invention, and the RGB-D sensor may be mounted specifically at a selected corresponding position to identify the passenger more clearly.

Continuously as shown in FIG. 1, the elevator system mainly includes an information analytic processing apparatus 120, the information 711 and the information 712 acquired from the RGB-D sensors are sent to the information analytic processing apparatus 120, and the information analytic processing apparatus 120 performs analytic processing on the information. The information analytic processing apparatus 120 may be disposed integrally, or may be disposed separately corresponding to each RGB-D sensor. Specifically, the information analytic processing apparatus 120 may be a PC server corresponding to the RGB-D sensor, and various collected RGB information and D information are transmitted to the PC server to perform real-time analytic processing, so as to implement detection and determination on children, and decide whether to generate an alarm message 610 according to a detection and determination situation. The information analytic processing apparatus 120 is a core component of an intelligent elevator control system, and by means of the alarm message 610 sent by it, the alarm message 610 being the basis of controllably trigger sending of a control command 620 in a subsequent process, it is conducive to ensuring the safety of children passengers. Exemplary illustrations are made in detail on the information analytic processing apparatus of the elevator system according to the embodiment of the present invention in the following at least with reference to FIG. 1 to FIG. 5, and a control method of the elevator system is also illustrated in an exemplary manner.

Figure 4:
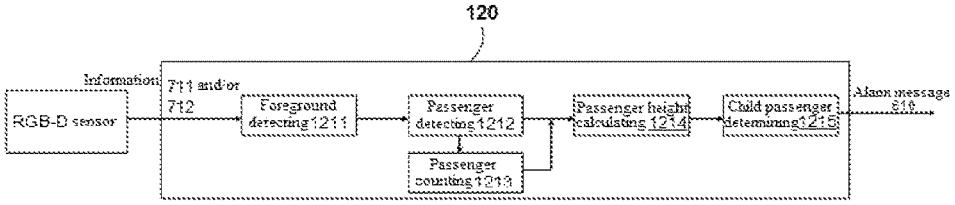
FIG. 4 is a schematic working principle diagram of an information analytic processing apparatus according to an embodiment.

FIG. 4 shows a schematic working principle diagram of an information analytic processing apparatus according to an embodiment. Referring to FIG. 1 to FIG. 4, the information analytic processing apparatus 120 may perform analytic processing on the information (711 and/or 712) from the RGB-D sensor 111 and/or 112. When being divided according to functional modules, in this embodiment, the information analytic processing apparatus 120 includes a foreground detecting module 1211, a passenger detecting module 1212, a passenger height calculating module 1214 and a child passenger determining module 1215. The information 711 or 712 includes the D information and the RGB information. To accurately detect a passenger, first, analytic processing is performed in the foreground detecting module 1211 on at least the D information of an area (for example, the passenger waiting area or the elevator cabin) monitored by the RGB-D sensor, for example, a background feature is extracted and calculated specifically, thereby obtaining foreground feature information. The information 711 and/or 712 may be acquired by the RGB-D sensor 111 and/or 112 respectively when there is no passenger.

Further, the foreground feature information obtained by the analytic processing performed by the foreground detecting module 1211 is transmitted to the passenger detecting module 1212, and the currently obtained D information is also transmitted to the passenger detecting module 1212. The obtained foreground information may include multiple passengers, the foreground information needs to be further divided according to the depth D information, so as to implement detection and separation of the passengers, for example, multiple passengers may be detected and counting is implemented.

Further, the passenger height calculating module 1214 performs calculation analysis at least based on the passenger detected by the passenger detecting module 1212 and the D information corresponding to the detected passenger to acquire a height feature of the passenger. In this embodiment, the passenger height calculating module 1214 may further acquire calibration information from the corresponding RGB-D sensor, for example, information that calibrates an angle, a position and the like of the sensor, and introduce the calibration information into the calculation analytic processing, thereby improving the accuracy of the calculation, and being advantageous in obtaining a more accurate height feature.

Further, the child passenger determining module 1215 determines whether each detected passenger is a child at least based on the height feature of the passenger 92, for example, determines that the passenger is a child when a height feature value is less than or equal to a predetermined value, and triggers sending of the alarm message 610 when all passengers are determined as children. It should be noted that, the predetermined value may be preset according to statistics on children heights, and different predetermined values may be set for different elevator types and/or different application scenarios. Moreover, it should be understood that, when there are both a child passenger and an adult passenger whose height feature is greater than the predetermined value in the passengers, it may be determined that the child in the current passenger waiting area 81 or the child in the elevator cabin 190 is accompanied by a guardian to take the elevator, and it may be considered as a relatively safe situation; therefore, the alarm message 610 may not be sent.

In the information analytic processing apparatus 120 in the above embodiment, because of the introduction of the D information, the detection on the passengers and the detection on the height features of the passengers are relatively more accurate, thereby being advantageous in improving the accuracy of determining children passengers. It should be noted that, the analytic processing on the D information may adopt various existing specific algorithms, and the algorithm type thereof is not limited.

In an embodiment, the information analytic processing apparatus 120 may further include a passenger counting module 1213, which makes statistics on the number of the passengers based on the detected passenger information after the passenger detection ends, and then sends the number result to the passenger height calculating module 1214.

Figure 5:
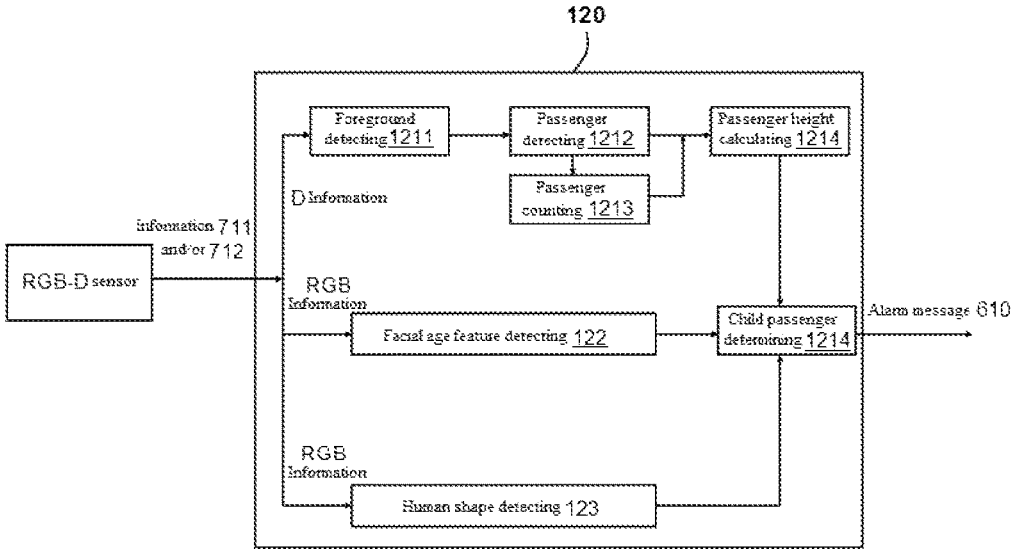
FIG. 5 is a schematic working principle diagram of an information analytic processing apparatus according to another embodiment.

FIG. 5 shows a schematic working principle diagram of an information analytic processing apparatus according to another embodiment. Compared with the information analytic processing apparatus in the embodiment shown in FIG. 4, the information analytic processing apparatus 120 of this embodiment further includes: a facial age feature detecting module 122 and/or a human shape detecting module 123. In the information analytic processing apparatus in the embodiment shown in FIG. 4, children passengers are generally determined based on height feature information; however, there may be mistaken determinations, for example, an adult passenger whose height is lower than the predetermined value. The facial age feature detecting module 122 and the human shape detecting module 123 further perform analytic processing in combination with the planar RGB information.

The applicant noticed that facial features of adult passengers and child passenger are different and are image identifiable. Therefore, the facial age feature detecting module 122 is further disposed in the information analytic processing apparatus 120, receives RGB information in the information 711 and/or 712, the RGB information being RGB information related to the passenger, and performs analytic processing on the RGB information, for example, extracts facial key feature information, thereby obtaining facial age feature information of each passenger. The facial age feature information of each passenger is sent to the child passenger determining module 1215, and the child passenger determining module 1215 determines whether each passenger is a child based on the facial age feature information. In combination with the determination based on the height feature information of the passenger, when the two determination processes both determine that the passenger is a child, the passenger is determined as a child, or when all passengers are determined as children in both of the two determination processes, the alarm message 610 is sent.

It should be noted that, in the analytic processing of the facial age feature detecting module 122, specific algorithms of various facial image recognition may be adopted, and the specific algorithm type is not limited.

On the other hand, the applicant noticed that shapes of adult passengers and child passenger are different and are image identifiable. Therefore, the human shape detecting module 123 is further disposed in the information analytic processing apparatus 120, receives RGB information in the information 711 and/or 712, the RGB information being RGB information related to the passenger, and performs image analytic processing on the RGB information, for example, extracts body shape feature information, thereby obtaining shape information of each passenger. The shape information of each passenger is sent to the child passenger determining module 1215, and the child passenger determining module 1215 determines whether each passenger is a child based on the shape information. In combination with the determination based on the height feature information of the passenger, when the two determination processes both determine that the passenger is a child, the passenger is determined as a child, or when all passengers are determined as children in both of the two determination processes, the alarm message 610 is sent.

It should be noted that, in the analytic processing of the shape detecting module 123, specific algorithms of various body shape image recognition may be adopted, and the specific algorithm type is not limited.

In other embodiments, in FIG. 5, the child passenger determining module 1215 may further determine whether all passengers are all children based on the height feature, the shape information and the facial age feature information together, and the alarm message 610 is sent when all the passengers are children.

It should be further understood that, a confirming apparatus 130 is further configured to cancel the sending of the control instruction 610 when it is confirmed that the passengers are not all children, so as to ensure normal running of the elevator system.

Continuously as shown in FIG. 1, the elevator system further includes the confirming apparatus 130, where the alarm message 610 is sent to the confirming apparatus 130, and the information acquired by the RGB-D sensor 111 and/or 112 may be sent to the confirming apparatus 130 indirectly by the information analytic processing apparatus 120, and may also be directly sent to the confirming apparatus 130. The confirming apparatus 130 may be disposed at a position convenient for a worker managing the elevator to monitor.

Figure 6:
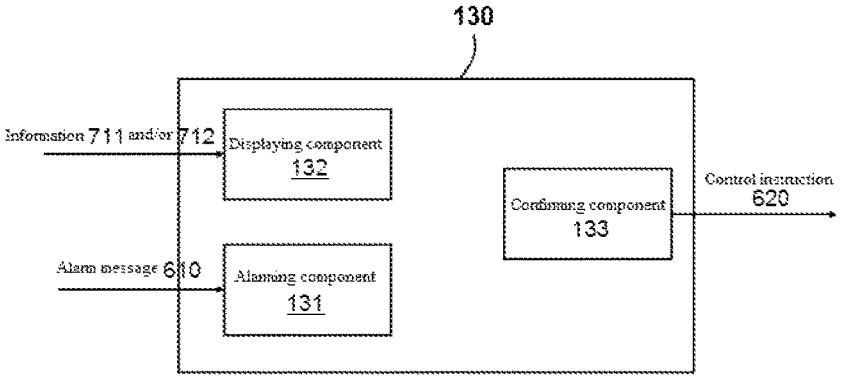
FIG. 6 is a schematic working principle diagram of a confirming apparatus according to an embodiment.

FIG. 6 shows a schematic working principle diagram of a confirming apparatus according to an embodiment. In this embodiment, the confirming apparatus 130 includes an alarming component 131, a displaying component 132, and a confirming component 133. The alarming component 131 may receive the alarm message 610, and trigger an alarm according to the received alarm message, so as to remind the worker managing the elevator to perform manual confirmation. The displaying component 132 may receive the information 711 and/or 712 sent by the RGB-D sensor, display the information in real time, especially the RGB information in the information acquired from the RGB-D sensor, thereby implementing displaying of a two-dimensional image. Further, in the confirming component 133, the worker managing the elevator may conveniently confirm whether the passengers in the current monitoring area are all children based on the display image, that is, perform further manual confirmation on the determination of the information analytic processing apparatus 120, so as to prevent a mistaken determination of the information analytic processing apparatus 120. The confirming component 133 sends the control instruction 620 used to ensure the children safety when it is determined that the passengers are all children, and specifically, the confirming component 133 is provided with a button, and the button is pressed based on the alarm and the displayed content to perform confirmation, thereby triggering the generation of the control instruction 620 based on the alarm message 610.

The disposition of the confirming apparatus 130 further implements accurate and reliable monitoring on the situation of children using the elevator, thereby preventing the normal running of the elevator system from being affected due to inaccurate monitoring on the situation of children using the elevator.

The control instruction 620 may be determined according to the specific situation of the elevator system.

For the passenger waiting area 81 of the vertical elevator system, if it is confirmed that the waiting passengers are all children, the control instruction 620 at least includes a first control instruction of ignoring an elevator call request of the current passenger waiting area, and in this way, when the child passenger calls the elevator in the passenger waiting area separately or alone, the elevator call request will be automatically ignored, so as to prevent the child passenger from taking the elevator separately or alone, and also be conducive to ensuring the running efficiency of the running elevator system.

For the elevator cabin 190 of the vertical elevator system, if it is confirmed that the passengers in the elevator cabin are all children, the control instruction 620 at least includes a second control instruction of ignoring a transport request in the elevator cabin, and in this way, when the child passenger presses a floor button on a panel 191 in the elevator cabin 190 separately or alone, the corresponding transport request will be automatically ignored, and the elevator cabin 190 will keep staying at the passenger waiting area, so as to prevent the child passenger from taking the elevator separately or alone.

Continuously as shown in FIG. 1, in the elevator system of this embodiment, optionally, a control instruction converting apparatus 140 is further provided, and the control instruction converting apparatus 140 receives one or more instructions in the control instruction 610 from the information analytic processing apparatus 120, and converts the instruction into a command message readable by an elevator controlling apparatus 150. The disposition of the control instruction converting apparatus 140 can easily implement the modification on the existing elevator system, so as to be compatible with the information analytic processing apparatus 120 of the elevator system of the present invention.

Continuously as shown in FIG. 1, in the elevator system of this embodiment, the elevator controlling apparatus 150 is further included, which is a control center of the elevator system, and responds to various instructions (for example, the control instruction 610) to send commands for controlling various components of the elevator system to act. The specific type, disposition manner and the like of the elevator controlling apparatus 150 are not limited.

It should be understood that, the elevator system according to the embodiment of the present invention may perform accurate determination on children passengers, can accurately and reliably monitor situations of children using the elevator, and can send corresponding control instructions in time, thereby preventing children from taking the elevator separately or alone, and greatly reducing the occurrence probability of accidents of children taking the elevator.

The elevator system in the embodiment shown in FIG. 1 is not limited to be applied in the vertical elevator system, and may also be analogically applied to, for example, an escalator system.

Figure 7:
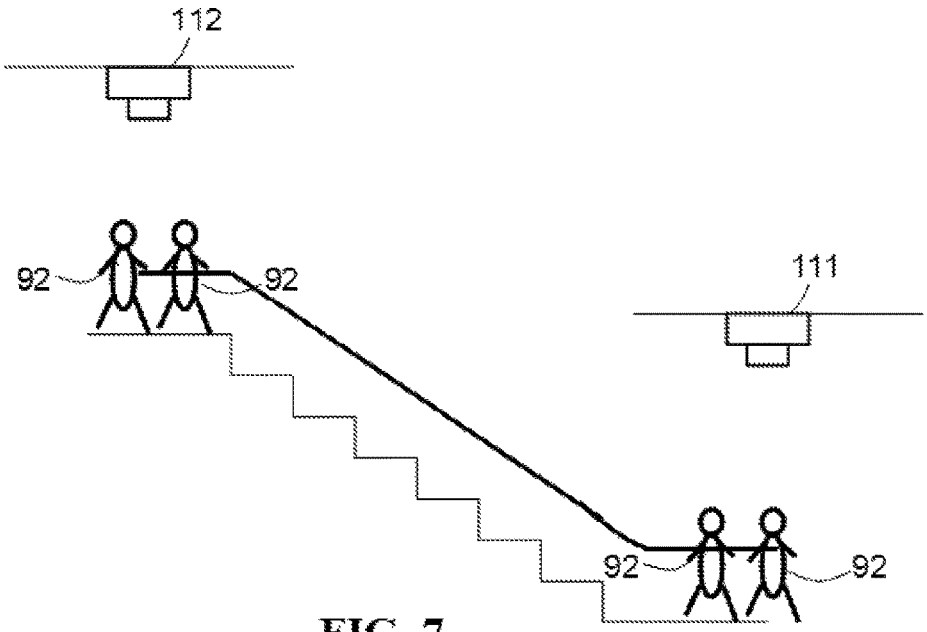
FIG. 7 is an exemplary schematic mounting diagram of mounting an RGB-D sensor in an escalator system.

FIG. 7 shows an exemplary schematic mounting diagram of mounting an RGB-D sensor in an escalator system. The RGB-D sensor 111/112 of the elevator system in the embodiment shown in FIG. 1 may be mounted at an exit/entrance of the escalator system, so as to monitor passengers at the exit/entrance position. The information analytic processing apparatus 120 and the confirming apparatus 130 of the escalator system as shown in FIG. 1 may also work based on the working principles in the embodiments shown in FIG. 4 to FIG. 6. In the case that the passengers at the exit/entrance position are all confirmed as children, a control instruction 610 is sent, and the control instruction 610 at least includes a third control instruction of stopping running of the escalator, so as to stop the running of the escalator in time, thereby ensuring the children safety. The control instruction 610 may further includes a fourth control instruction of sending a warning broadcast, so as to perform warning broadcasting in time to remind the guardian or worker around the children to notice and take corresponding measures.

Figure 8:
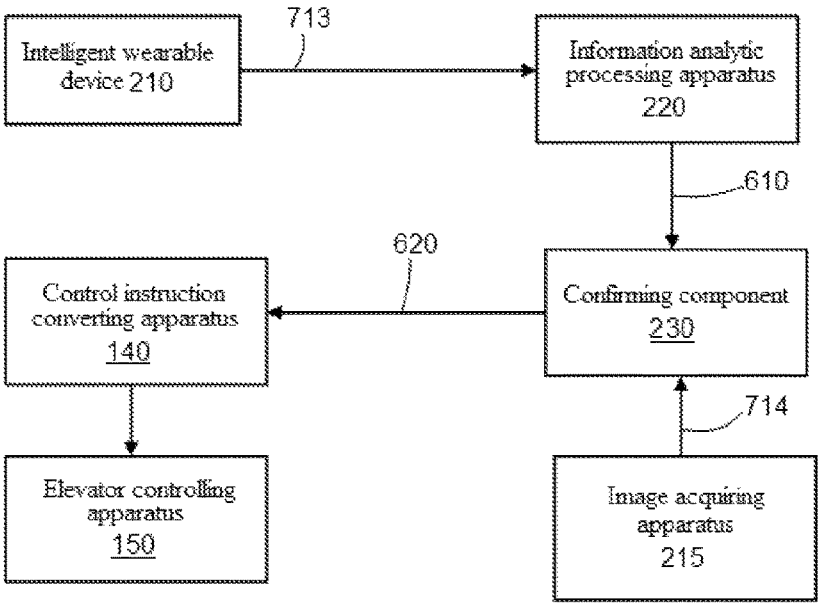
FIG. 8 is a schematic modular structural diagram of an elevator system according to another embodiment of the present invention.

FIG. 8 shows a schematic modular structural diagram of an elevator system according to another embodiment of the present invention. In this embodiment, the elevator system mainly includes an intelligent wearable device 210 and an information analytic processing apparatus 220. The intelligent wearable device 210 stores age feature information of a passenger wearing this device 210, and the age feature information may be specifically a certain age or a certain age range. The intelligent wearable device 210 may be owned and worn by the passenger, and may also be distributed by a building where the elevator system is located for the passengers to wear. The intelligent wearable device 210 may specifically be an RFID card, a smart phone, a smart bracelet, or the like, and the specific type thereof is not limited in the embodiment of the present invention.

Continuously as shown in FIG. 8, the information analytic processing apparatus 220 is configured to acquire the age feature information from the intelligent wearable device 210. In an embodiment, the information analytic processing apparatus 220 may include an apparatus that is disposed in a predetermined area of the building and similar to a base station, and when a passenger carrying the intelligent wearable device 210 enters this predetermined area (for example, a passenger waiting area or an elevator cabin), the information analytic processing apparatus 220 may automatically read the age feature information stored in the intelligent wearable device 210, and therefore, the acquisition of the age feature information is very convenient. The information analytic processing apparatus 220 further perform real-time analytic processing on the age feature information to implement detection and determination on a child, so as to determine whether a child uses the elevator. In still another embodiment, the information analytic processing apparatus 220 further determines whether to generate the alarm message 610 according to the detection and determination situation. The information analytic processing apparatus 220 is a core component of an intelligent elevator control system, and by means of the alarm message 610 sent by it, the alarm message 610 being the basis of controllably trigger sending of a control command 620 in a subsequent process, it is conducive to ensuring the safety of children passengers.

Continuously as shown in FIG. 8, to further improve the accuracy of determining the children using the elevator, the elevator system is further provided with a confirming component 230 and an image acquiring apparatus 215. The image acquiring apparatus 215 may be similar to the RGB-D sensor 111 and/or 112 in the embodiments shown in FIG. 1, and mounting and disposing manners thereof corresponding to the vertical elevator system and the escalator system are basically the same as the mounting and disposing of the RGB-D sensor in the embodiment shown in FIG. 1 (see FIG. 2, FIG. 3 and FIG. 7), and the RGB information acquired by the RGB-D sensor is directly or indirectly sent to the confirming component 230 to perform real-time displaying. In still another embodiment, the image acquiring apparatus 215 may be a 2D smart IP camera, and 2D image information of passengers acquired by the image acquiring apparatus is transmitted to the confirming component 230. It should be understood that, the specific type of the image acquiring apparatus 215 is not limited in the embodiment of the present invention.

The confirming component 230 receives the alarm message and can display the image information transmitted by the image acquiring apparatus 215 at least when receiving the alarm message 610. The worker is reminded to perform manual confirmation after the alarm message 610 is received, and the confirming component 230 is further configured to confirm whether the passengers are all children at least based on the displayed image information, and send the control instruction 620 used to ensure children safety when it is confirmed that the passengers are all children. The specific configuration of the confirming component 230 is basically the same as the confirming component 130 of the elevator system in the embodiment shown in FIG. 1, for example, it may be configured to work according to the modular structure shown in FIG. 6. The control instruction 620 sent by the confirming component 230 may also be determined according to the specific situation of the elevator system.

Continuously as shown in FIG. 8, in the elevator system of this embodiment, optionally, a control instruction converting apparatus 140 is further provided, and the control instruction converting apparatus 140 receives one or more instructions in the control instruction 610 from the information analytic processing apparatus 120, and converts the instruction into a command message readable by the elevator controlling apparatus 150. The disposition of the control instruction converting apparatus 140 can easily implement the modification on the existing elevator system, so as to be compatible with the information analytic processing apparatus 120 of the elevator system of the present invention.

Continuously as shown in FIG. 8, in the elevator system of this embodiment, the elevator controlling apparatus 150 is further included, which is a control center of the elevator system, and responds to various instructions (for example, the control instruction 610) to send commands for controlling various components of the elevator system to act. The specific type, disposition manner and the like of the elevator controlling apparatus 150 are not limited.

The elevator system according to the embodiment shown in FIG. 8 may directly acquire the age feature information of the passengers by means of the intelligent wearable device, so as to perform accurate determination on children passengers, can accurately and reliably monitor situations of children using the elevator, and send corresponding control instructions in time, thereby preventing children from taking the elevator separately or alone, and greatly reducing the occurrence probability of accidents of children taking the elevator.

It should be understood that, when it is so-called that a component is "connected" or "coupled" to another component, it may be directly connected or coupled to another component, or there may be an intermediate component. In contrast, when it is so-called that a component is "directly coupled" or "directly connected" to another component, there is no intermediate component.

In the present invention, the elevator system refers to a passenger transporting apparatus disposed in a building, and the specific type thereof is not limited to the vertical elevator system and the escalator system in the embodiments. For example, it may also be a moving walkway system. Persons skilled in the art may analogically apply the present invention to other types of elevator systems according to the teaching and inspiration of the above embodiments, so as to at least implement the function of monitoring children using the elevator.

The elevator system and the control method thereof in the present invention are mainly illustrated in the above examples. Some implementation manners of the present invention are described; however, persons of ordinary skill in the art should understand that the present invention may be implemented in many other forms without departing from the substance and scope thereof, for example, a certain module of the information analytic processing apparatus 120 shown in FIG. 4 is deleted. Therefore, the displayed examples and implementation manners are considered as schematic instead of limited, and the present invention may incorporate various modifications and replacements without departing from the spirit and scope of the present invention defined in the accompanying claims.

What is claimed is:

1. An elevator system capable of monitoring children use, comprising an elevator controlling apparatus, wherein the elevator system further comprises:

an RGB-D sensor, mounted at a predetermined position to at least acquire red green blue (RGB) information and depth (D) information; and an information analytic processing apparatus, configured to perform real-time analytic processing on at least the D information or a combination of the RGB information and the D information, so as to implement detection and determination on a child;

wherein the information analytic processing apparatus is further configured to send an alarm message when passengers are all determined as children; and the elevator system further comprises: a confirming apparatus, configured to receive the alarm message and real-time display at least the RGB information acquired by the RGB-D sensor at least when the alarm message is received, and configured to confirm whether the passengers are all children based on at least the displayed RGB information, and send a control instruction used to ensure children safety to the elevator controlling apparatus when it is confirmed that the passengers are all children.

2. The elevator system according to claim 1, wherein the information analytic processing apparatus comprises:

a foreground detecting module, configured to perform, at least based on the D information, analytic processing on an area monitored by the RGB-D sensor to obtain foreground feature information;

a passenger detecting module, configured to perform analytic processing at least based on the D information as well as the foreground feature information to detect a passenger;

a passenger height calculating module, configured to perform calculation analysis at least based on the D information corresponding to the detected passenger to acquire a height feature of the passenger; and a child passenger determining module, configured to determine whether each passenger is a child at least based on the height feature of each passenger, and send the alarm message when all passengers are determined as children.

3. The elevator system according to claim 2, wherein the information analytic processing apparatus further comprises: a passenger counting module, configured to make statistics on the number of the passengers.

4. The elevator system according to claim 2, wherein the information analytic processing apparatus further comprises: a facial age feature detecting module, configured to perform analytic processing at least based on the RGB information related to the passenger to obtain facial age feature information of each passenger; and further, the child passenger determining module is further configured to determine whether each passenger is a child based on the facial age feature information.

5. The elevator system according to claim 2, wherein the information analytic processing apparatus further comprises: a human shape detecting module, configured to perform analytic processing at least based on the RGB information related to the passenger to obtain shape information of each passenger; and further, the child passenger determining module is further configured to determine whether each passenger is a child based on the shape information.

6. The elevator system according to claim 1, wherein the confirming apparatus comprises:

an alarming component, configured to trigger an alarm according to the received alarm message;

a displaying component, configured to real-time display the RGB information acquired by the RGB-D sensor; and an confirming component, configured to confirm whether the passengers are all children at least based on the displayed RGB information, and send a control instruction used to ensure children safety when it is confirmed that the passengers are all children.

7. The elevator system according to claim 1, further comprising:

a control instruction converting apparatus, configured to convert the control instruction into a command message readable by the elevator controlling apparatus.

8. The elevator system according to claim 1, wherein the elevator system is a vertical elevator system comprising an elevator cabin, and the RGB-D sensor comprises a first RGB-D sensor disposed at a passenger waiting area of the vertical elevator system.

9. The elevator system according to claim 8, wherein the control instruction used to ensure children safety at least comprises a first control instruction of ignoring an elevator call request of the passenger waiting area.

10. The elevator system according to claim 8, wherein the RGB-D sensor further comprises a second RGB-D sensor disposed in the elevator cabin of the vertical elevator system.

11. The elevator system according to claim 10, wherein the control instruction used to ensure children safety at least comprises a control instruction of ignoring a transport request in the elevator cabin.

12. The elevator system according to claim 1, wherein the elevator system is an escalator system, and the RGB-D sensor comprises a first/second RGB-D sensor disposed at an exit/entrance of the escalator system.

13. The elevator system according to claim 12, wherein the control instruction used to ensure children safety at least comprises a control instruction of stopping running of an escalator.

14. The elevator system according to claim 13, wherein the control instruction used to ensure children safety at least comprises a control instruction of sending a warning broadcast.

15. The elevator system according to claim 1, wherein the confirming apparatus is further configured to cancel the sending of the control instruction when it is confirmed that the passengers are not all children, so as to ensure normal running of the elevator system.

16. An elevator system control method capable of monitoring children use, comprising:

at least acquiring RGB information and depth (D) information through an RGB-D sensor;

performing real-time analytic processing on at least the D information or a combination of the RGB information and the D information, so as to implement detection and determination on a child, and sending an alarm message when passengers are determined as all children;

real-time displaying through a confirming apparatus, at least the RGB information acquired by the RGB-D sensor at least when the alarm message is received, by the confirming apparatus, and confirming through the confirming apparatus whether the passengers are all children based on the displayed RGB information; and sending a control instruction used to ensure children safety when it is confirmed that the passengers are all children.

17. The elevator system control method according to claim 16, wherein the performing real-time analytic processing comprises:

performing, at least based on the D information, analytic processing on an area monitored by the RGB-D sensor to obtain foreground feature information;

performing analytic processing at least based on the D information as well as the foreground feature information to detect a passenger;

performing calculation analysis at least based on the D information corresponding to the detected passenger to acquire a height feature of each passenger; and determining whether each passenger is a child at least based on the height feature of the passenger, and sending the alarm message when all passengers are determined as children.

* * * * *